US007119496B2

(12) United States Patent
Haus et al.

(10) Patent No.: US 7,119,496 B2
(45) Date of Patent: Oct. 10, 2006

(54) INVERTER FOR LIQUID CRYSTAL DISPLAY, AND POWER SUPPLY ARRANGEMENT COMPRISING SUCH AN INVERTER

(75) Inventors: Thomas A. J. Haus, Eindhoven (NL); Hendrik W. J. De Groot, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/480,129

(22) PCT Filed: Jun. 5, 2002

(86) PCT No.: PCT/IB02/02061

§ 371 (c)(1),
(2), (4) Date: Dec. 9, 2003

(87) PCT Pub. No.: WO02/103665

PCT Pub. Date: Dec. 27, 2002

(65) Prior Publication Data

US 2004/0160791 A1 Aug. 19, 2004

(30) Foreign Application Priority Data

Jun. 14, 2001 (EP) ..... 01202295

(51) Int. Cl.
*H05B 41/16* (2006.01)
*H05B 37/00* (2006.01)

(52) U.S. Cl. ..... 315/255; 315/312

(58) Field of Classification Search ..... 315/160, 315/161, 246–247, 276, 287, 250, 254, 255, 315/312; 345/211–212; 349/56
See application file for complete search history.

(56) References Cited

U.S. PATENT DOCUMENTS

| | | | | |
|---|---|---|---|---|
| 4,865,425 | A | 9/1989 | Kobayashi et al. | 350/345 |
| 5,126,637 | A * | 6/1992 | Watts et al. | 315/219 |
| 5,694,312 | A * | 12/1997 | Brand et al. | 363/144 |
| 5,790,389 | A * | 8/1998 | Hua | 363/20 |
| 5,894,412 | A * | 4/1999 | Faulk | 363/17 |
| 5,982,642 | A * | 11/1999 | Herfurth | 363/21.08 |
| 6,020,867 | A * | 2/2000 | Shimada et al. | 345/87 |
| 6,225,708 | B1 * | 5/2001 | Furukawa et al. | 307/66 |
| 6,510,995 | B1 * | 1/2003 | Muthu et al. | 235/454 |

* cited by examiner

*Primary Examiner*—Thuy Vinh Tran

(57) ABSTRACT

A power supply arrangement is provided for supplying power to a plurality of back and/or edge illumination devices (5) in a liquid crystal display unit (1), comprising a mains connection (7), a power converter (6) and at least one inverter (8). The power converter (6) is arranged to convert an AC voltage input to a DC voltage output, and the inverter (8) is connected to said DC voltage output, and arranged to convert said output to a DC voltage level adequate for driving said illumination devices (5). Furthermore, the inverter (8) is provided with mains isolation. By virtue of this arrangement, no conventional adapter is required, and the LCD can be connected directly to the mains. The conversion down to a low DC voltage is eliminated, without violating the current-limitation safety requirements. This leads to a more effective power supply.

6 Claims, 3 Drawing Sheets

Figure 1:
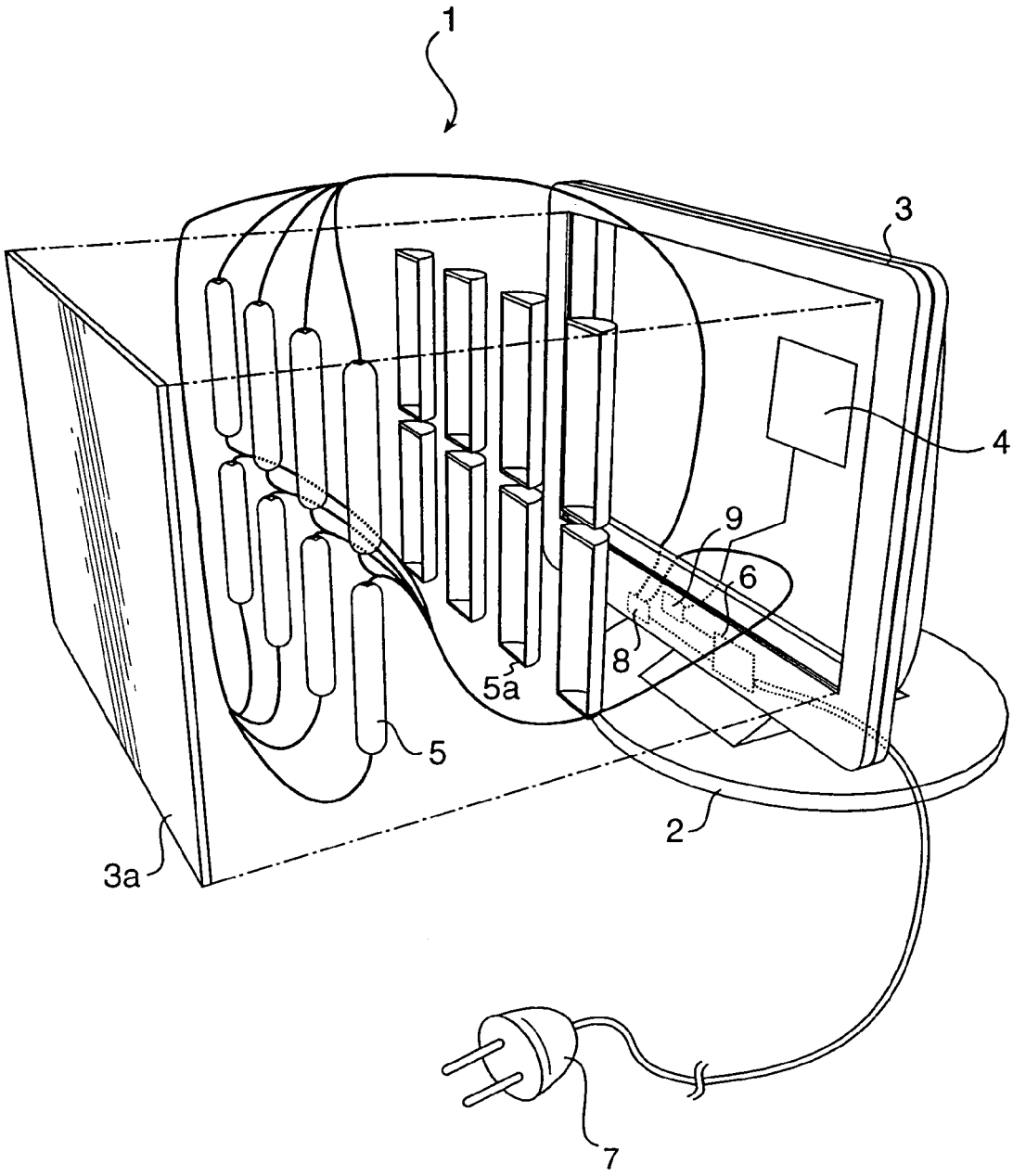

INVERTER FOR LIQUID CRYSTAL DISPLAY, AND POWER SUPPLY ARRANGEMENT COMPRISING SUCH AN INVERTER

This Application is a National Phase Application under 35 U.S.C. 371 claiming the benefit of PCT/IB02/02061 filed on Jun. 05, 2002, which has priority based on European Patent Office (EPO) Application No. 01202295.0 filed on Jun. 14, 2001.

The present invention relates to an inverter for use in a liquid crystal display unit. The invention also relates to a power supply arrangement for supplying power to a plurality of back or edge illumination devices in a liquid crystal display unit, comprising a mains connection, a power converter and at least one inverter.

A power supply for discharge lamps in a liquid crystal display device is known from e.g. U.S. Pat. No. 4,865,425. Such a power supply is provided with an inverter for each lamp, said inverter comprising an oscillator and a step-up transformer to generate a voltage that is high enough to ignite the lamp.

Conventional liquid crystal display devices have a mains-isolated power supply located in the pedestal of the monitor, where there is sufficient space, or in a separate adapter. From this power supply, a lower voltage (e.g. 12 V DC) is supplied to the screen portion, where a plurality of inverters are arranged. Each inverter converts forms the lower DC voltage to an appropriate level (e.g. 3 kV) needed for igniting the lamps.

In order to fulfill the safety requirements related to current limitations, conventional inverter transformers have a limited power output of approximately 10W. Therefore, each inverter only drives one or two lamps.

Even though safety regulations would allow an increase of the power supplied by the power supply to maximally 47 V DC, this would only lead to a minor power increase and most of the power would be wasted as losses in the inverters.

As will be clear from the foregoing, the mains voltage must be first converted down to 12 V and then converted up to the required voltage in the inverters. This is an inefficient procedure. Furthermore, several inverters are required for driving the lamps, typically four inverters for driving eight lamps.

It is an object of the present invention to overcome the above-mentioned problems and provide a power supply for the back or edge illumination of an LCD that only requires one inverter.

A second object of the invention is to provide an improved power supply arrangement in an LCD.

According to the invention, these and other objects are achieved by a power supply arrangement for supplying power to a plurality of back illumination devices in a liquid crystal display, wherein the power converter is arranged to convert an AC voltage input to a DC voltage output, the inverter is connected to said DC voltage output and is arranged to convert said output to a voltage level adequate for driving said illumination devices, and the inverter is provided with mains isolation.

By using this arrangement a conventional adapter can be dispensed with and the LCD can be connected directly to the mains. The conversion down to a low DC voltage is eliminated without violating the current-limitation safety requirements. This leads to a more effective power supply.

Another advantage is that a larger power output can be delivered by the inverter, also without violating the current-limitation safety requirements. As a consequence, only one inverter is required for driving several, at least four, back illumination devices. This reduces the complexity and the cost of each LCD.

The LCD unit typically comprises also a circuit power supply, which is connected to said power converter output, and arranged to generate voltage levels required by control circuitry in the LCD. This circuit power supply is preferably also provided with mains isolation, so that the entire LCD is isolated from the mains. In comparison with a conventional LCD power supply, the mains isolation normally present in the adapter has been divided and moved forward to the inverter and the circuit power supply, respectively.

According to a preferred embodiment, the power converter and the inverter are arranged in a screen portion of the LCD. This leads to a very practical and efficient design, where the mains is simply connected to the screen portion of the LCD. Thus, no connection wires are required in the moving joint between the pedestal and the screen.

The power converter output preferably has a voltage level that it higher than the voltage level of the AC input, and that ranges for example from 200–600 V. This voltage level makes it possible to generate the power required for driving several, for example eight, lamps, without excessive power losses.

The power converter can be a PFC circuit.

A second aspect of the present invention relates to an inverter for use in a LCD, provided with mains isolation means. It is noted that this concept is novel in LCD power supply, and that it enables a more cost effective and power effective power supply arrangement.

These and other aspects of the invention will be apparent from the preferred embodiments more clearly described with reference to the appended drawings.

FIG. 1 is a schematic view of a power supply arrangement in an LCD unit according to an embodiment of the invention.

Figure 2A:
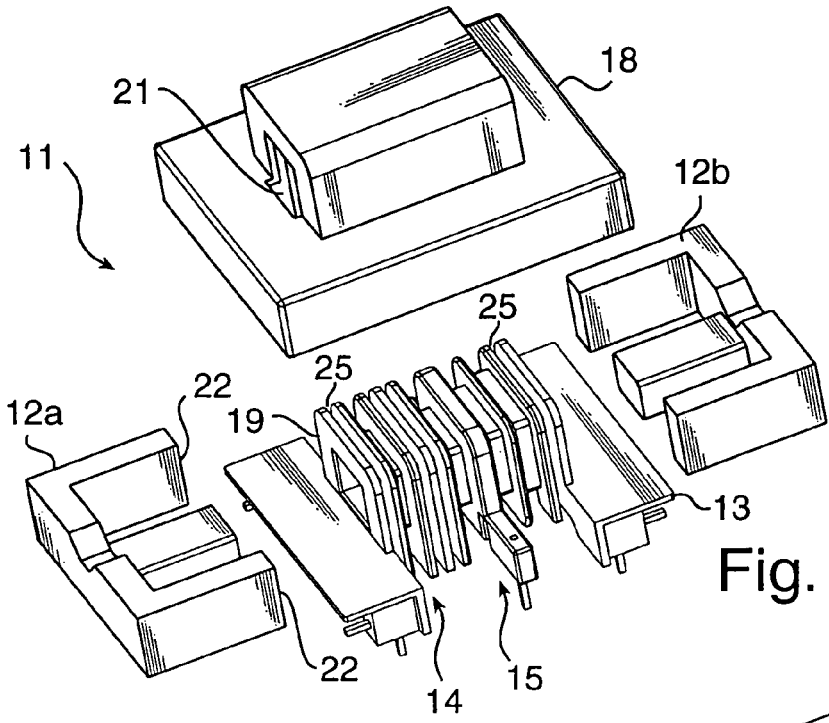
Figure 2B:
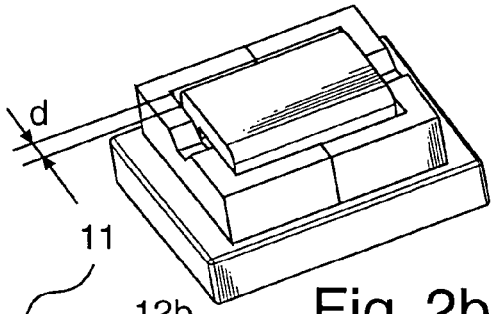
Figure 2C:
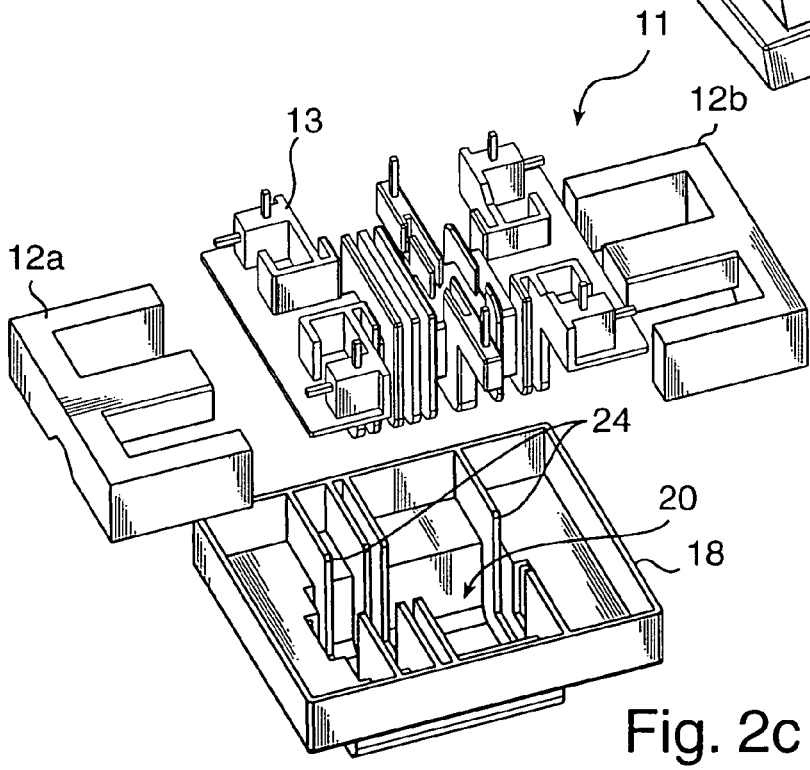

FIG. 2*a–c* show various perspective views of the inverter in FIG. 1.

Figure 3:
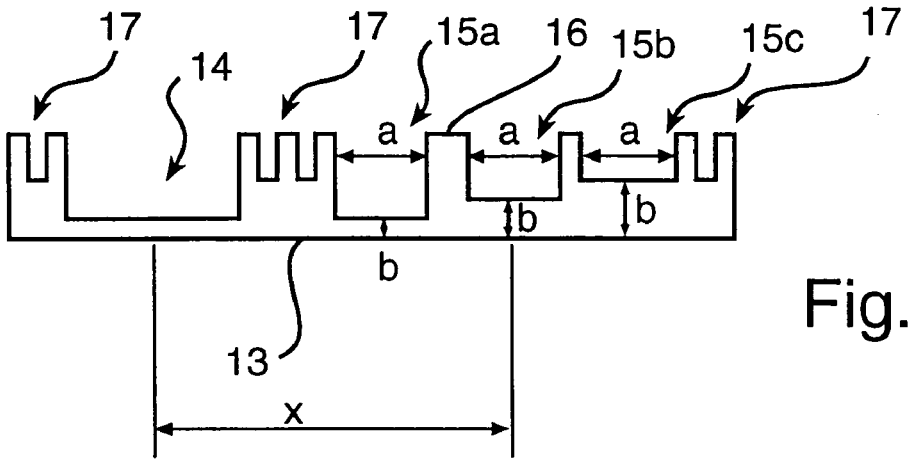

FIG. 3 is a schematic sectional view of the coil former of the inverter in FIG. 2.

Figure 4A:
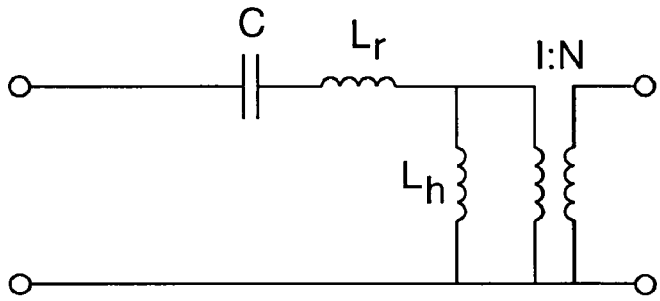
Figure 4B:
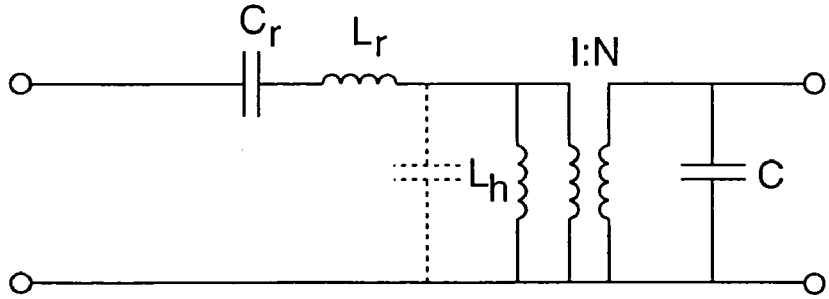

FIG. 4*a–b* show examples of LLC and LLCC circuits.

FIG. 1 shows a schematic view of a power supply arrangement in a LCD unit according to an embodiment of the invention. The LCD unit 1 has a pedestal portion 2 and a screen portion 3 in which the liquid crystal display 3*a* is housed together with its control electronics 4. The screen portion also contains a number of background illumination devices in the form of lamps 5 with reflectors 5*a*. A power converter in the form of a power factor correction (PFC) circuit 6 is arranged in the lower part of the screen portion 3, and is connected to the mains 7, normally 90–250 V AC, in the illustrated example 230 V AC. The PFC circuit 6 delivers a 400 V DC, and comprises no mains isolation.

The DC output is supplied to an inverter 8, also arranged in the screen portion 3. The inverter 8 is adapted to convert the PFC DC output to a voltage more suitable for driving the lamps 5, typically around 3 kV. The DC voltage from the PFC is also supplied to a conventional low-voltage transformer 9 that is adapted to generate voltages required by the control electronics 4 of the LCD, typically 3V, 5V and 12V.

The inverter 8 and the power transformer 9 are both provided with mains isolation, thereby satisfying the safety requirements for the LCD. While this is straightforward in the case of the conventional low voltage transformer 9, it is more complicated in the case of the inverter 8.

The transformer section 11 of the inverter 8 is shown in FIGS. 2–3, and comprises a core consisting of two E-shaped parts 12*a* and 12*b*, and a coil former 13 for forming compartments 14, 15 for the primary and secondary coil windings (the winding turns are not shown).

In order to avoid problems caused by breakdown and corona, in spite of the limited space available in the transformer 11, the coil former 13 is formed with flanges or flares 16 dividing the secondary winding compartment into several sections. On each side of the windings, the separating flanges are double, forming so called labyrinths 17.

Furthermore, the secondary sections have varying wall thicknesses towards the core 12*a*, 12*b*, in order to avoid corona and breakdown problems between the secondary winding and the core.

In the example illustrated in FIGS. 2–3, there are three secondary sections 15*a*–15*c*. The material thickness b in each section increase with the distance from the primary winding, the first section having a wall thickness of 0.7 mm, the second section having a wall thickness of 1.5 mm and the third section having a thickness of 2.1 mm. This means that a decreasing number of layers can be housed in each section; 22 layers in the first section, 17 layers in the second and 12 in the third section. The width a of the sections 15*a*–*c* can nevertheless be equal, so that each layer in each section contains an equal number of turns, in the preferred embodiment 19 turns. The inverter in FIGS. 2–3 has a primary winding with 110 turns, and a secondary winding with almost 1000 turns divided among the three sections.

The design described herein eliminates the need for filling the inverter with resin or the need to use insulating tape, thus saving costs.

Before the core 12*a*, 12*b* is inserted into the corresponding opening of the coil former 13, the coil former 13 is placed in a casing 18. The portion 19 of the coil former 13 intended to receive the core is arranged in a groove 20 of the casing, said groove having openings 21 on either side. The core parts 12*a*, 12*b* are then inserted into the coil former 13 through these openings 21, thereby fixing the coil former 13 and the casing 18 together. Note that the outer sections 22 of the core 12*a*, 12*b* are separated from the sides of the casing 18 by a small distance d, preferably 1–2 mm. This distance further reduces corona problems.

Flanges 24 along the sides of the groove 20 in the casing 18 are adapted to be received by grooves 25 formed in the above-mentioned labyrinths 17 in the side of the coil former 13.

The inverter in accordance with the design illustrated herein generates an output voltage on the secondary side of around 2,5 kV when the input voltage on the primary side is 250 V.

Apart from the transformer functionality, the inverter constitutes a LLC or a LLCC circuit, such as illustrated in FIGS. 4*a* and 4*b*. The spread between the primary and secondary windings is preferably selected so that the self-inductance can function as a substitute for a ballast coil in the LLC or LLCC circuit.

In the transformer illustrated in FIGS. 2–3, the distance X between the centers of the primary and the secondary windings is in approximately 2 cm in order to accomplish the desired spread.

A number of modifications of the described embodiments are possible within the scope of the appended claims. For example, the details regarding the inverter design, such as wall thickness, number of flares, number of primary and/or secondary winding sections etc., may be modified by persons skilled in the art.

It should be understood that by increasing the winding compartments and the core, and increasing the number of windings, a larger power can be taken from the inverter.

The invention claimed is:

1. Power supply arrangement for supplying power to a plurality of back and/or edge illumination devices (5) in a liquid crystal display unit (LCD) (1), comprising: a mains connection (7), a power converter (6), and at least one inverter (8), the power converter (6) having an input directly coupled to the mains connection (7) and having a first output coupled to an input of the at least one inverter (8), the power converter (6) being arranged to convert an AC voltage input to a power converter (6) DC voltage output, said power converter (6) DC voltage output being supplied to an input of the at least one inverter (8), the at least one inverter (8) being arranged to convert said power converter (6) DC voltage output to a AC output voltage level adequate for driving said illumination devices (5), and in that said at least one inverter (8) is provided with mains isolation via said power converter (6), the power supply arrangement further comprising a circuit power supply (9), connected to a second output of said power converter (6), and arranged to generate voltage levels required by circuitry (4) in the LCD, said circuit power supply (9) also being provided with mains isolation via said power converter (6).

2. Arrangement according to claim 1, wherein said inverter (8) is arranged to supply power for driving at least four lamps (5).

3. Arrangement according to claim 1, wherein said LCD unit (1) comprises a screen portion (3), and wherein said power converter (6) and said inverter (8) are arranged in said screen portion (3).

4. Arrangement according to claim 1, wherein said power converter output has a DC voltage output level that is higher than the voltage level of the AC input.

5. Arrangement according to claim 4, wherein said power converter DC voltage output level is in a range 200V–600 V.

6. Arrangement according to claim 1, wherein said power converter is a Power Factor Correction (PFC) circuit (6).

* * * * *